US005623841A

United States Patent [19]

Deemar

[11] Patent Number: 5,623,841

[45] Date of Patent: Apr. 29, 1997

[54] TWO-WAY LOCKING SYSTEM AND METHOD

[76] Inventor: Ira Deemar, Rte. 2 Box 130, South Haven, Mich. 49090

[21] Appl. No.: 528,473

[22] Filed: Sep. 12, 1995

[51] Int. Cl.[6] ..... E05B 73/00

[52] U.S. Cl. ..... 70/14; 292/262; 292/288; 292/289

[58] Field of Search ..... 70/2–8, 14; 292/2, 292/262, 263, 265, 268, 281, 288, 289

[56] References Cited

U.S. PATENT DOCUMENTS

| | | | |
|---|---|---|---|
| 2,536,941 | 1/1951 | Jones | 292/288 |
| 2,918,318 | 12/1959 | Sacharski | 292/288 X |
| 3,181,319 | 5/1965 | Hudon | 292/289 X |
| 3,572,796 | 3/1971 | Willner | 292/288 |
| 3,834,746 | 9/1974 | Hinden | 70/14 X |
| 3,938,839 | 2/1976 | Collier | 292/288 X |
| 3,997,205 | 12/1976 | MacDonald | 292/288 |
| 4,124,240 | 11/1978 | Adelberg | 292/262 |
| 4,288,119 | 9/1981 | Geiger | 292/262 |
| 4,326,394 | 4/1982 | Stein | 70/14 |
| 4,399,672 | 8/1983 | Moorhouse | 292/289 X |
| 5,004,279 | 4/1991 | Radcliff | 292/288 |
| 5,291,760 | 3/1994 | Schrader | 292/289 X |
| 5,361,539 | 11/1994 | Widener | 292/288 X |
| 5,415,444 | 5/1995 | Hull et al. | 292/288 |
| 5,501,494 | 3/1996 | Willetts | 292/262 |

FOREIGN PATENT DOCUMENTS

| | | | |
|---|---|---|---|
| 2230293 | 10/1990 | United Kingdom | 292/289 |

OTHER PUBLICATIONS

Junkunc Publication, Safety Hasp or Safety Hasp Unit, Jan. 11, 1938.

*Primary Examiner*—Suzanne Dino
*Attorney, Agent, or Firm*—Laff, Whitesel, Conte & Saret, Ltd.

[57] ABSTRACT

A two-way locking system and method wherein a pair of entryway members which are moveable relative to each other may be separately accessed by separate locks from each side. A strap passes between the confronting edges of each entryway member, and a first separate lock is associated with the strap on one face of one of the entryway members and a second separate lock is associated with the strap on a face of the other entryway member on the other side of the boundary formed by the entryway member pair. A person on a first side of the boundary cannot gain access to the lock on the other side of the boundary until the person releases the lock on the first side of the boundary.

26 Claims, 4 Drawing Sheets

TWO-WAY LOCKING SYSTEM AND METHOD

BACKGROUND OF THE INVENTION

Many systems are available for securing and locking relatively moveable, cooperating entryway members, such as a pair of swinging gates, a pair of door members which slide toward and away, a post and an associated swinging gate or fence section, etc. Typically such systems provide a lock on one side of the pair of cooperating entryway members, such as on the ingress side.

In many situations, once the lock has been released on the ingress side and the user has passed through, such as to the egress side, it is no longer possible to use the lock on the ingress side to again make secure the pair of members against unauthorized entry from the ingress side. Further, if the lock on the ingress side is made secure, unless special structures, such as pass through latches are positioned on the egress side, it is not possible to gain access to the lock on the ingress side.

It would be desirable to provide an integrated two-way locking system for the confronting free edges of a pair of entryway members, which system permits both ingress from the ingress side of the member pair and egress from the egress side of the member pair, which permits access from each side separately, and where the locking system includes independently usable locking means which are integrated but are separately accessible, one from the ingress side and the other from the egress side.

SUMMARY OF THE INVENTION

In accordance with the present invention, an improved system and method for controlling ingress and egress through a pair of entryway members is provided. The system comprises an integrated two-way locking system for the confronting free edges of a pair of entryway members for permitting ingress from a first ingress side of the member pair and egress from a second egress side of the member pair, and includes a strap having a first segment confronting one of the pair of entryway members on the ingress side and a second segment confronting the other of the pair of entryway members on the egress side, a first lock element on the one entryway member confronting the first segment and a second lock element on the other entryway member confronting the second segment, the first segment having first means for engaging the first lock element to facilitate securance of the first segment to the first entryway member and to secure the entryway member pair from the ingress side, and the second segment having second means for engaging the second lock element to facilitate securance of the second segment to the second entryway member and to secure the entryway member pair from the egress side, the first and second means being independently usable and being separately accessible, one from the ingress side only and the other from the egress side only.

In one form the strap is a Z-shaped bar, the first and second engaging means comprise slots defined by the first and second segments respectively, the first and second lock elements include loops, and a padlock is secured to each of the first and second lock elements. The strap may be rigid and has a third segment connecting the first and second segments, which third segment lies between the free edges of the pair of entryway members.

In another form the strap is flexible and may comprise a flexible third segment connecting the first and second segments.

The pair of entryway members may be hingedly mounted at locations remote from their free edges. At least one of the pair of entryway members may be mounted to reciprocate toward and away from the other of the entryway members.

In another form the first and second engaging means comprise separate locks mounted, respectively, on the first and second sections. Preferably the locks are key locks each having a latch member and each entryway member mounts an aperture defining plate for receiving a confronting latch member for locking the entryway member to the strap thereat.

The invention also comprises a method of providing security for a pair of entryway members which have confronting free edges and which edges are moveable relative to each other to provide ingress and egress, the method comprising the steps of providing a strap which passes between the confronting free edges and which has a first portion confronting the face portion of a first of the entryway members and a second portion confronting the opposite face portion of a second of the entryway members, and a separate locking means for each of the face portion and confronting strap portion, opening and separating one of the locking means to permit passage between the pair of entryway members from one side of the pair of entryway members to the other side of the pair of entryway members, opening and separating the other of the locking means, reattaching and resecuring the one locking means, and reattaching and resecuring the other locking means.

Further objects, features and advantages of the present invention will become apparent from the following description and drawings.

DETAILED DESCRIPTION

Figure 1:
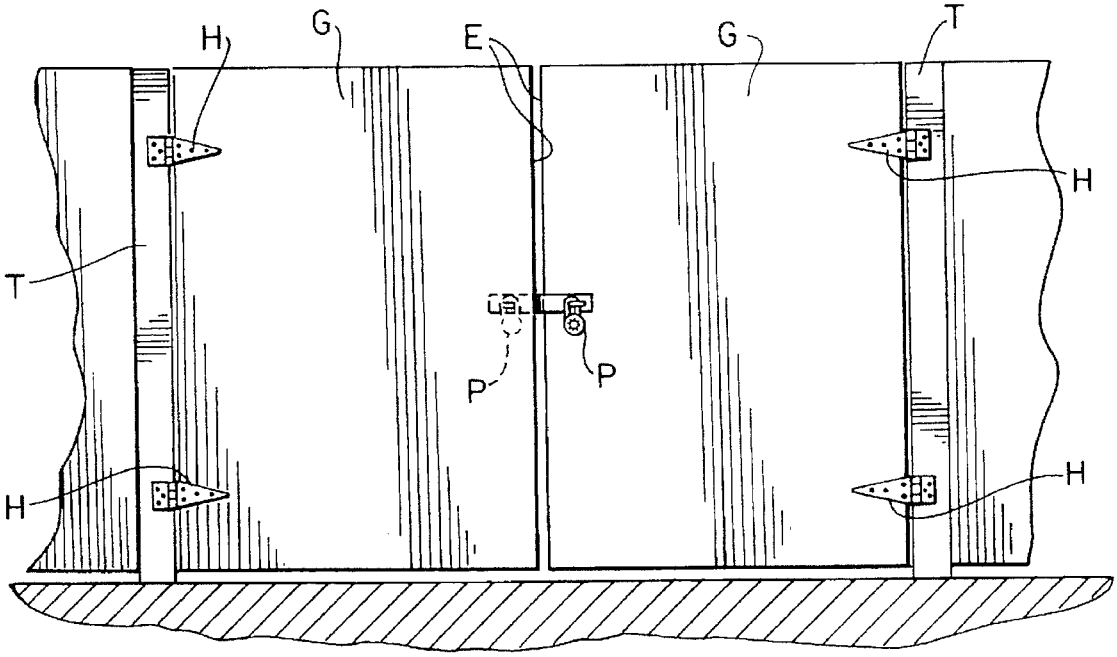
FIG. 1 is a front view of an integrated two-way locking system for securing a pair of entryway members in accordance with the present invention.
Figure 2:
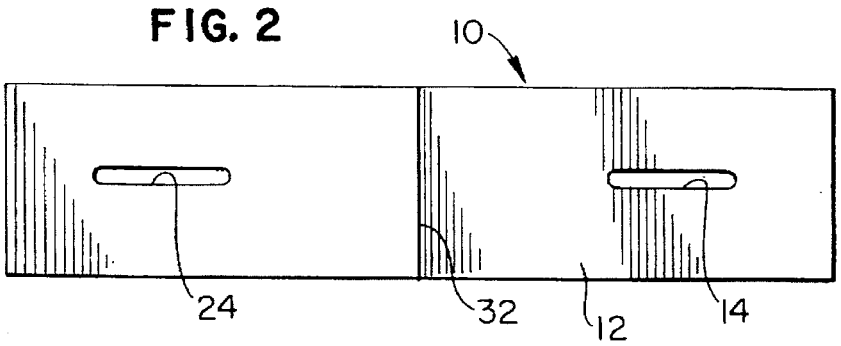
FIG. 2 is a front elevational view of the strap of the locking system of FIG. 1.
Figure 3:
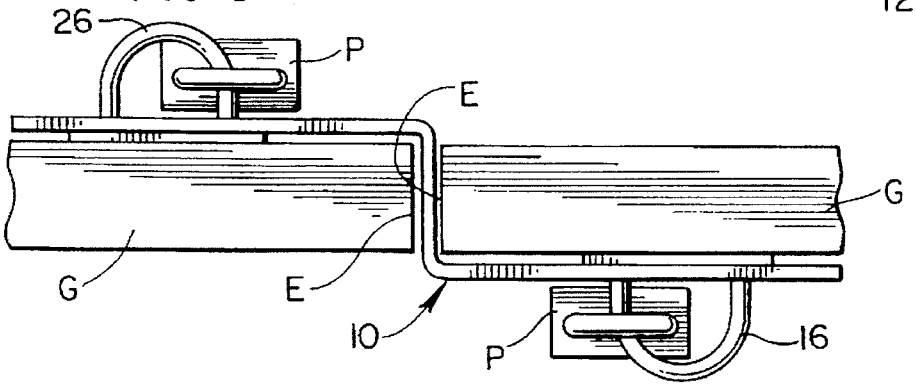
FIG. 3 is a fragmentary top plan view of FIG. 1.
Figure 3A:
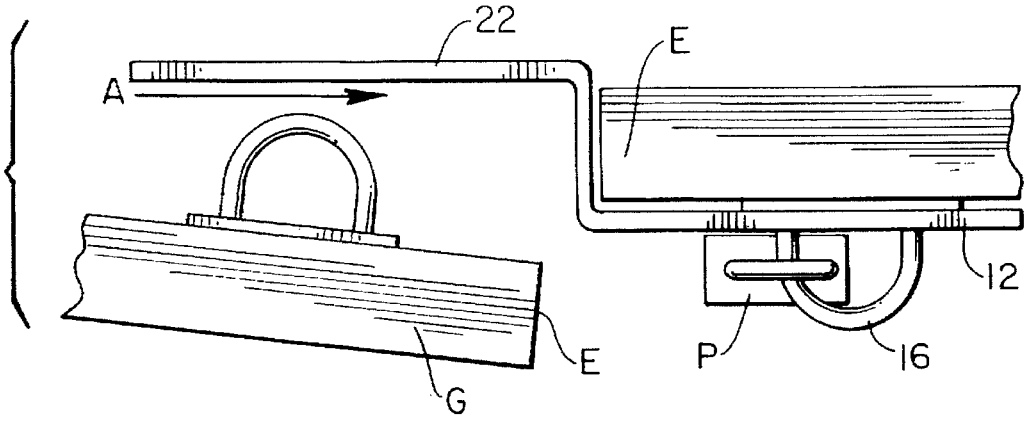
FIG. 3A is a fragmentary plan view like FIG. 3, but with the locking system opened from the egress side to permit egress.

Referring now to the drawings, and to FIGS. 1–3C, inclusive, in particular, an integrated two-way locking system in accordance with the present invention is there shown in association with a pair of entryway members, in this case comprising a pair of gates G which are hingedly mounted as on pivots such as hinges H so that each swings freely in and out on a post T. Gates G have confronting free edges E which can be brought into alignment, as illustrated in FIGS. 1 and 3. In this embodiment each of the pair of entryway members is hingedly mounted at a location remote from its free edge E. It will be apparent that one side of the pair of gates can be viewed as the ingress side and the other side can be viewed as the egress side.

The two-way locking system of the present invention includes a unitary strap 10, in this case a Z-shaped bar or strap member. On the ingress side the strap 10 includes a first section or segment 12 which is adapted to confront a first of the gates G on its ingress side. On the egress side, the strap includes a second section or segment 22 which is adapted to confront a second of the gates G on its egress side. The first and second sections 12 and 22 define slots 14, 24, respectively. Sections 12 and 22 are joined by a third integrating or connecting section or segment 32, a pass through section, which passes through or between the confronting edges E of the gates G and which is of a dimension sufficient to permit the sections 12 and 22 to face the confronting face portions of the gates G.

The first and second gates G define first and second lock elements, respectively, on the ingress and egress sides, respectively. These lock elements may comprise plate mounted loops 16, 26 of a conventional type mounted on opposite gate faces at the gate edges E. Loops 16, 26 are disposed so that the slots 14, 24 are positioned to engage and receive them to facilitate securance of the first loop 16 with the first slot 14 and securance of the second loop 26 with the second slot 24, one on the ingress side and the other on the egress side.

In this case, the cooperating locking members, the loop and slot, on each side, are provided with a lock such as padlock P. Because each gate G comprises a generally solid panel construction, the padlock P on one side is accessible, in use, from one side only and the padlock on the other side is accessible, in use, from the other side only. Each is independently usable, but, as will be apparent, the integrating strap 10 makes it possible to open the gate or closure pair from either side.

Although a pair of hingedly mounted gates which allow swinging of each in and out has been illustrated in FIGS. 1 to 3C, they may swing unidirectionally only as well. It will also be apparent that the member pair to be joined by the two way locking system can include a door or gate and a post as the member pair defining the entryway. The door or gate can be mounted to swing or can be mounted to slide or reciprocate relative to the post. Similarly, the member pair could be a pair of gates or doors, the confronting edges of which slide towards and away from each other and into an array in which a strap 10 may be similarly juxtaposed therewith and be secured and locked thereto.

Figure 4:
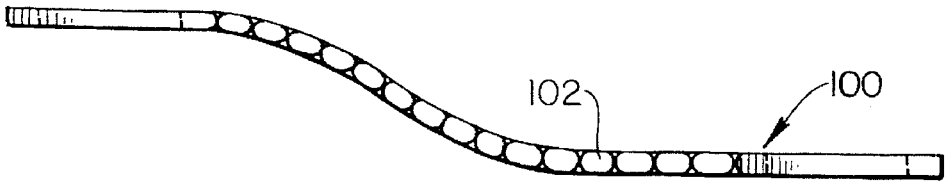
FIG. 4 is a top plan view of an alternative embodiment of a strap of the present invention.
Figure 5:
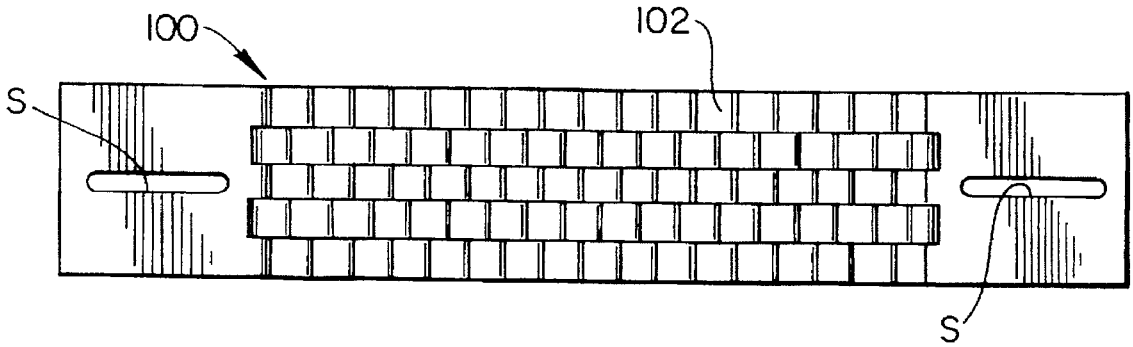
FIG. 5 is a front elevational view of FIG. 4.
Figure 6:
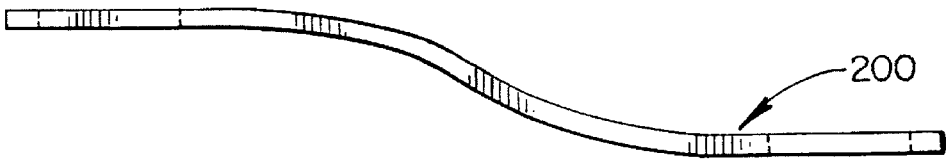
FIG. 6 is a top plan view of another embodiment of a strap of the present invention.

The strap member 10 and its several sections may be shaped as by bending, or may be formed, as by welding or brazing sections to each other. A strap member 100 may also be a member having a flexible mid-section 102 and slots S (like slots 14, 24) in the outer portions thereof and is illustrated by FIGS. 4 and 5, or such a strap member may be entirely flexible or may even be a flexible member 200 of spring steel or the like (as shown in FIG. 6) which defines similar slots or other locking elements which cooperate with loops or the like.

Figure 7:
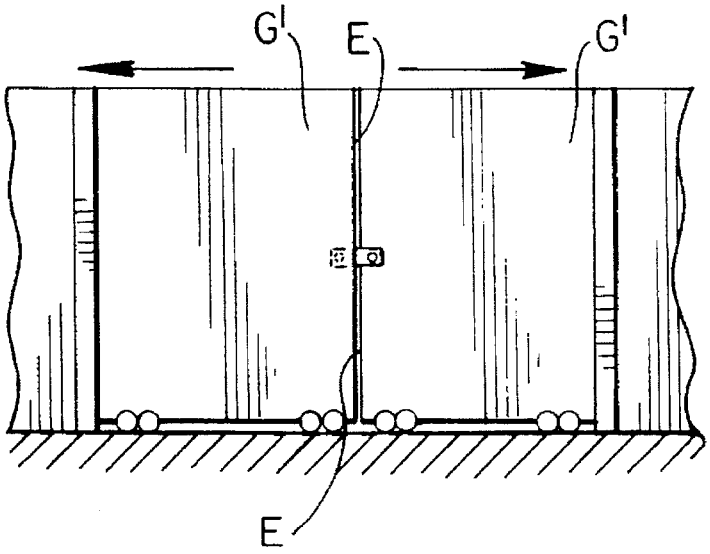
FIG. 7 is a fragmentary front view of two gates which open by sliding toward and away from each other joined by a further locking system of the present invention.
Figure 8:
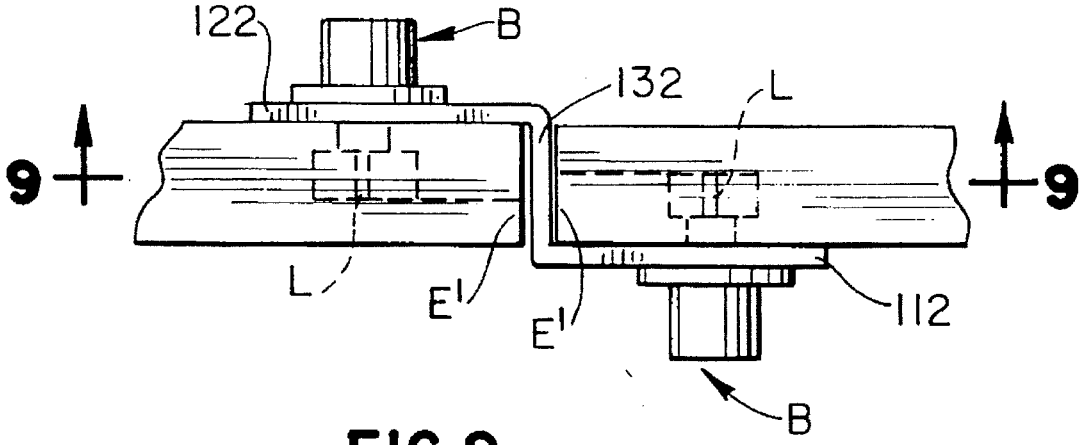
FIG. 8 is a fragmentary top plan view of FIG. 7.
Figure 9:
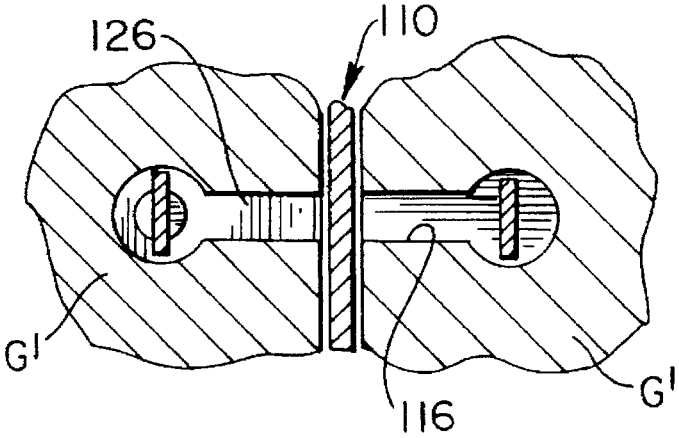
FIG. 9 is a sectional view taken substantially along line 9—9 of FIG. 8.

In the embodiment illustrated in FIGS. 7–9, a strap 110 includes a first segment or section 112 which, like section 12, is adapted to confront a face of a first of a pair of entryway members G' which are adapted to move relative to each other, and a second segment or section 122 which is adapted to confront a face of the other of the entryway members, one on the ingress side and the other on the egress side. Sections 112 and 122 are joined by an intermediate connecting section 132 which passes between the confronting edges E' of the members G'. Section 132 is proportioned so that sections 112 and 122 may appropriately face the confronting face portions of members G'.

In this embodiment, sections 112, 122 mount locks such as key operated barrel locks B. Each may be key operable and may have an oscillatable latch means L. Each entryway member G' is provided with a plate assembly having a cooperating lock member in the form of an aperture 116, 126. Apertures 116 and 126 are shaped to receive the latches L in one position (the unlocked position) of oscillation thereof and to prevent withdrawal of the oscillated latch L therefrom in a second position (the locked position) of oscillation thereof.

Again, as in the case of the embodiment of FIGS. 1–3C, the locking apertures and latches are positioned to engage on the ingress and egress sides, respectively, to facilitate locking and unlocking from opposite sides and to provide access, in use, from one side only for each of the lock assemblies. Each lock operates independently, but the integrating strap 110 makes it possible to open the entryway member pair from either side independently of each other.

The locks B used may both be key locks having a common key or different keys; combination locks may also be used, or combinations of kinds and types of locks may be used as well. It will be apparent that as long as one of the locks is engaged, the strap is retained in position and is ready to be reengaged from the other side i.e., the lock members on the other side are ready for juxtapositioning and securance.

Figure 3B:
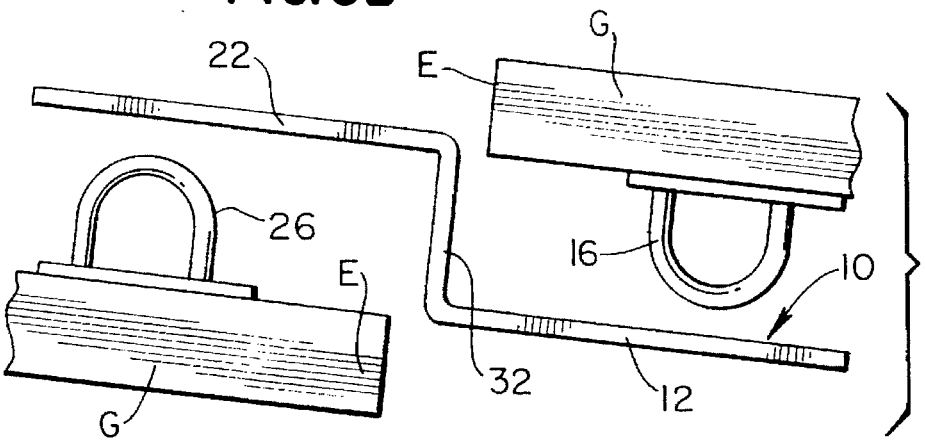
FIG. 3B is a fragmentary plan view like FIG. 3, but with the locking system opened also on the ingress side to permit relocking of the system on the egress side.
Figure 3C:
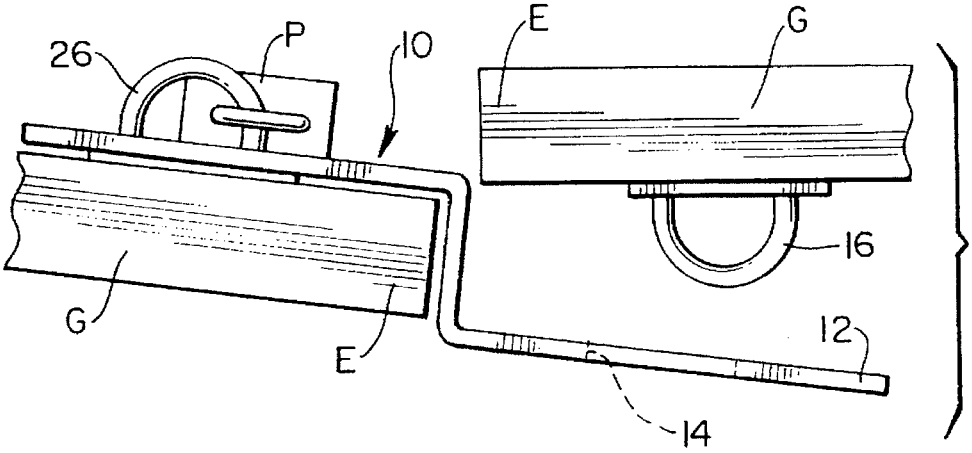
FIG. 3C is a fragmentary plan view like FIG. 3, but with the locking system relocked on the egress side after egress.

The use of a two-way locking system of the present invention is typically illustrated by FIGS. 3, 3A, 3B, and 3C. In FIG. 3, an assembly is shown in which the entryway members are locked from both the ingress side and the egress side. A person on one side or the other can gain access only to the lock on the side of the entryway on which the person is located. If it is assumed that the user is on the egress side of FIG. 3, the user will first open, disengage and remove the egress side padlock P. At that time, the gates G are moveable relative to each other so that, for example, the left hand gate G may be pushed open so that the loop 26 exits the slot 24 and so that the user is permitted to pass in the direction of the arrow A in FIG. 3A. The user then removes the padlock P from the ingress side and the Z-bar on the ingress side as represented by FIG. 3B. Then the lock and Z-bar is reattached and resecured on the egress side as illustrated by FIG. 3C. Finally, the gate G is again closed and the ingress side lock is reattached and resecured as shown by FIG. 3.

Similar sequences are followed regardless of the directions in which the gates swing, whether the gates reciprocate (slide towards and away from each other) rather than swing, or whether the entryway members are a door and door post, etc.

It will be apparent that a pin or unlocked padlock may be used with the embodiment of FIGS. 1–3C on the egress side (when it is reasonably secure) to restrain the entryway member pair from being breached from the ingress side.

From the foregoing, it will be observed that numerous modifications and variations can be effected without departing from the spirit and scope of the present invention. It will be appreciated that the present disclosure is intended as an exemplification of the invention, and is not intended to limit the invention to the specific embodiments illustrated and described. The disclosure is intended to cover all such modifications as fall within the scope of the claims.

What is claimed is:

1. An integrated two-way locking system for the confronting free edges of a pair of entryway members which permits ingress from a first ingress side of said member pair and egress from a second egress side of said member pair, comprising a strap, said strap having a first segment confronting one of said pair of entryway members on said ingress side and a second segment confronting the other of said pair of entryway members on said egress side, a first lock element fastened to said one entryway member and confronting said first segment and a second lock element fastened to said other entryway member and confronting said second segment, said first segment having first means for engaging said first lock element to facilitate securance of said first segment to said first entryway member and to secure said entryway member pair from said ingress side, and said second segment having second means for engaging said second lock element to facilitate securance of said second segment to said second entryway member and to secure said entryway member pair from said egress side, said first and second means being independently usable and being separately accessible, one from said ingress side only and the other from said egress side only.

2. A two-way locking system in accordance with claim 1, and wherein said strap is a rigid Z-shaped bar.

3. A two-way locking system in accordance with claim 1, and wherein said first and second engaging means comprise slots defined by said first and second segments respectively.

4. A two-way locking system in accordance with claim 1, and wherein said strap has a third segment connecting said first and second segments and lying between the free edges of said pair of entryway members.

5. A two-way locking system in accordance with claim 1, and wherein said strap is flexible.

6. A two-way locking system in accordance with claim 5, and wherein said strap comprises a flexible third segment connecting said first and second segments.

7. A two-way locking system in accordance with claim 1, and wherein at least one of said pair of entryway members is hingedly mounted at a location remote from its free edge.

8. A two-way locking system in accordance with claim 1, and wherein at least one of said pair of entryway members is mounted to reciprocate toward and away from the other of said entryway members.

9. A two-way locking system in accordance with claim 1, and wherein said first and second engaging means comprise separate locks mounted, respectively, on said first and second segments.

10. A two-way locking system in accordance with claim 9, and wherein said locks are key locks each having a latch member.

11. A two-way locking system in accordance with claim 10, and wherein each said entryway member has an aperture defining plate fastened thereto for receiving a confronting latch member for locking said entryway member to said strap thereat.

12. An integrated two-way locking system for the confronting free edges of a pair of entryway members which permits ingress from a first ingress side of said member pair and egress from a second egress side of said member pair, comprising a strap, said strap having a first segment confronting one of said pair of entryway members on said ingress side and a second segment confronting the other of said pair of entryway members on said egress side, a first lock element on said one entryway member confronting said first segment and a second lock element on said other entryway member confronting said second segment, said first segment having first means for engaging said first lock element to facilitate securance of said first segment to said first entryway member and to secure said entryway member pair from said ingress side, and said second segment having second means for engaging said second lock element to facilitate securance of said second segment to said second entryway member and to secure said entryway member pair from said egress side, said first and second means being independently usable and being separately accessible, one from said ingress side only and the other from said egress side only, and wherein said first and second engaging means comprise slots defined by said first and second segments respectively, and wherein said first and second lock elements include loops.

13. A two-way locking system in accordance with claim 12, and further including a padlock secured to each of said first and second lock elements.

14. A two-way locking means mountable on a pair of entryway members for securing the confronting free edges of a pair of entryway members to permit ingress from a first ingress side of the member pair and to permit egress from a second egress side of the member pair, comprising a strap, said strap having a first segment for confronting one of a pair of entryway members on an ingress side thereof, and a second segment for confronting the other of said pair of entryway members on an egress side thereof, a first lock element for mounting to said one entryway member for confronting said first segment and a second lock element for mounting to said other entryway member for confronting said second segment, said first segment having first means for engaging a first lock element on one of said pair of entryway members to facilitate securance of said first segment to a said first entryway member on an ingress side, said second segment having second means for engaging a second lock element on the other of said pair of entryway members to facilitate securance of said second segment to a said second entryway member on an egress side, said first and second means being independently usable and being separately accessible in use, one from a said ingress side only and the other from a said egress side only, and wherein said first and second engaging means comprise slots defined by said first and second segments respectively, and wherein said first and second lock elements include loops.

15. A two-way locking means in accordance with claim 14, and further including a padlock secured to each of said first and second lock elements.

16. A two-way locking means in accordance with claim 14, and wherein said strap has a third segment connecting said first and second segments and adapted to lie between the free edges of said pair of entryway members.

17. A two-way locking means in accordance with claim 14, and wherein said strap is flexible.

18. A two-way locking means in accordance with claim 17, and wherein said strap comprises a flexible third segment connecting said first and second segments.

19. A two-way locking means in accordance with claim 14, and wherein said first and second engaging means comprise separate locks mounted, respectively, on said first and second segments.

20. A two-way locking means in accordance with claim 19, and wherein said locks are key locks each having a latch member.

21. A two-way locking means in accordance with claim 20, and wherein said entryway members are adapted to mount aperture defining plates, each for receiving a confronting latch member for locking a said entryway member to said strap thereat.

22. A method of providing security for a pair of entryway members which have confronting free edges and which edges are moveable relative to each other to provide ingress and egress, the method comprising the steps of providing a strap which passes between the confronting free edges and which has a first portion confronting the face portion of a first of the entryway members and a second portion confronting the opposite face portion of a second of the entryway members, and first and second separate locking means, one for each said face portion and confronting strap portion, said first locking means having a portion thereof fastened to a confronting face portion of one entryway member, and said second locking means having a portion thereof fastened to a confronting face portion of the other entryway member, opening and separating one of said locking means to permit passage between said pair of entryway members from one side of said pair of entryway members to the other side of said pair of entryway members, opening and separating the other of said locking means, reattaching and resecuring the one said locking means, and reattaching and resecuring the other said locking means.

23. The method in accordance with claim 22, and wherein said strap provided is a rigid Z-shaped bar.

24. The method in accordance with claim 22, and wherein each of said locking means comprises a separate lock.

25. The method in accordance with claim 22, and wherein said strap provided is flexible.

26. The method in accordance with claim 22, and wherein at least one of said pair of entryway members is hingedly mounted at a location remote from its free edge.

* * * * *